US010121612B2

(12) United States Patent
Pagliuzza et al.

(10) Patent No.: US 10,121,612 B2
(45) Date of Patent: Nov. 6, 2018

(54) DOOR MONITORING CONTACT SWITCH DEVICE

(71) Applicants: Mario Pagliuzza, Barrington, IL (US); Karel Hauk, Warrenville, IL (US); Steven Pagliuzza, South Barrington, IL (US); Daniel Ott, Elburn, IL (US)

(72) Inventors: Mario Pagliuzza, Barrington, IL (US); Karel Hauk, Warrenville, IL (US); Steven Pagliuzza, South Barrington, IL (US); Daniel Ott, Elburn, IL (US)

(73) Assignee: DIAL TOOL INDUSTRIES, INC., Addison, IL (US)

( * ) Notice: Subject to any disclaimer, the term of this patent is extended or adjusted under 35 U.S.C. 154(b) by 0 days.

(21) Appl. No.: 15/392,892

(22) Filed: Dec. 28, 2016

(65) Prior Publication Data

US 2017/0186568 A1 Jun. 29, 2017

Related U.S. Application Data

(60) Provisional application No. 62/327,595, filed on Apr. 26, 2016, provisional application No. 62/272,317, filed on Dec. 29, 2015.

(51) Int. Cl.
*H01H 13/12* (2006.01)
*H01H 13/14* (2006.01)

(52) U.S. Cl.
CPC ..... *H01H 13/14* (2013.01)

(58) Field of Classification Search
CPC ..... H01H 13/14
USPC ..... 200/531, 331, 547–549, 551
See application file for complete search history.

(56) References Cited

U.S. PATENT DOCUMENTS

| | | | |
|---|---|---|---|
| 2,662,969 | A | 12/1953 | Dague |
| 2,783,318 | A | 2/1957 | Brown |
| 2,816,972 | A | 12/1957 | Haut |
| 3,466,408 | A | 9/1969 | Basso |
| 4,168,411 | A | 9/1979 | Peck |
| 4,319,106 | A | 3/1982 | Armitage |
| 4,406,935 | A | 9/1983 | Montag et al. |
| 4,554,618 | A | 11/1985 | Bafunno et al. |
| 4,683,521 | A | 7/1987 | Poleschuk et al. |

(Continued)

FOREIGN PATENT DOCUMENTS

| | | | |
|---|---|---|---|
| JP | 2011210601 | A | 10/2011 |
| JP | 2013222596 | A | 10/2013 |

(Continued)

OTHER PUBLICATIONS

International Search Report and Written Opinion for International Application No. PCT/US2016/069297 filed Dec. 29, 2016.

*Primary Examiner* — Ahmed Saeed
*Assistant Examiner* — Lheiren Mae A Caroc
(74) *Attorney, Agent, or Firm* — Vedder Price P.C.

(57) ABSTRACT

A contact switch including a rail having slot with a first straight section and a second curved section, a toggle unit inside a housing, the toggle unit including an extension unit that slidably engages the slot and at least one contact, a contact unit in the housing including at least one contact, where the toggle unit moves in the housing such that the contacts on the toggle unit engage at least one contact on the stationary unit in the first straight section and the contacts disengage in the second curved section.

12 Claims, 9 Drawing Sheets

(56) References Cited

U.S. PATENT DOCUMENTS

| | | | | |
|---|---|---|---|---|
| 4,698,466 | A | 10/1987 | Beck et al. | |
| 4,851,625 | A * | 7/1989 | Liebich | H01H 15/005 200/302.1 |
| 4,967,045 | A | 10/1990 | Keefer | |
| 4,979,083 | A | 12/1990 | Takano et al. | |
| 5,264,670 | A | 11/1993 | Leonard | |
| 7,878,035 | B2 * | 2/2011 | Yamaguchi | B60R 7/06 200/43.11 |
| 2003/0172695 | A1 | 9/2003 | Buschmann | |
| 2007/0187195 | A1 | 8/2007 | Park | |
| 2012/0175204 | A1 | 7/2012 | Arnold et al. | |

FOREIGN PATENT DOCUMENTS

| | | | |
|---|---|---|---|
| KR | 101044803 | B1 | 6/2011 |
| KR | 1020140012237 | A | 2/2014 |

* cited by examiner

DOOR MONITORING CONTACT SWITCH DEVICE

PRIORITY CLAIM

This application claims priority to and the benefit of U.S. Provisional Patent Application Ser. No. 62/327,595, filed Apr. 26, 2016, and claims priority to and the benefit of U.S. Provisional Patent Application Ser. No. 62/272,317, filed Dec. 29, 2015, the entire contents of which are incorporated herein by reference.

BACKGROUND OF THE INVENTION

Contact switches play an important role in the operation of automated devices including the control of lighting. Contact switches are used to monitor the position of devices, such as glove compartment doors, refrigerator doors and other devices. In a typical glove compartment design, a contact switch is used to control an interior light of the glove compartment. In more advanced applications, a glove compartment switch may report back to a central computer that alerts a driver of an open compartment door.

One challenge faced by designers of contact switches is the reliability and form factor of the switches in relation to the mechanical device being monitored. Conventional contact switches have been plagued with reliability issues including providing false positioning signals, which result in improper operation of the controlled device. Further, conventional contact switches have been intrusive to the mechanical design of the devices monitored to the extent that the designs must be manipulated to accommodate the contact switch.

With more and more devices in the market requiring automation, the need exists for a contact switch that is both reliable and form fitting to the application it is designed to serve.

BRIEF SUMMARY OF THE INVENTION

One embodiment includes contact switch including a rail having slot with a first straight section and a second curved section, a toggle unit inside a housing, the toggle unit including an extension unit that slidably engages the slot and at least one contact;

a contact unit in the housing including at least one contact, wherein the toggle unit moves in the housing such that the contacts on the toggle unit engage at least one contact on the stationary unit in the first straight section and the contacts disengage in the second curved section.

In one embodiment, the contact unit includes two contacts affixed to a back surface of the contact unit with the contacts being offset from one side of the back surface.

In one embodiment, the contact unit includes four contacts.

In one embodiment, the contact unit includes an extension unit on a bottom surface with the extension unit being sized to engage a groove extending along the length of the rail.

In one embodiment, the extension unit passes through a slot in a bottom portion of the housing.

In one embodiment, the stationary unit includes two contacts.

In one embodiment, a pin is positioned between the two contacts on the stationary unit.

In one embodiment, a cover on the housing.

In one embodiment, the stationary unit includes a second contact on a side of the stationary unit opposite the first contacts.

Another embodiment includes glove compartment switch including a gear, a rail connected to the gear, the rail having a slot with a first straight section and a second curved section, a toggle unit inside a housing, the toggle unit including an extension unit that slidably engages the slot and at least one contact;

a contact unit in the housing including at least one contact, where the toggle unit moves in the housing such that the contacts on the toggle unit engage at least one contact on the stationary unit in the first straight section and the contacts disengage in the second curved section, and the contacts on the stationary unit connected to a second set of contacts positioned on one side of the rail.

In one embodiment, the contact unit includes two contacts affixed to a back surface of the contact unit with the contacts being offset from one side of the back surface.

In one embodiment, the contact unit includes four contacts.

In one embodiment, the contact unit includes an extension unit on a bottom surface with the extension unit being sized to engage a groove extending along the length of the rail.

In one embodiment, the extension unit passes through a slot in a bottom portion of the housing.

In one embodiment, the stationary unit includes two contacts.

In one embodiment, a pin is positioned between the two contacts on the stationary unit.

In one embodiment, a cover is positioned on the housing.

In one embodiment, the stationary unit includes a second contact on a side of the stationary unit opposite the first contacts.

In one embodiment, the second set of contacts are connected to a light.

In one embodiment, the light is turned on when the contacts are aligned.

DETAILED DESCRIPTION OF THE INVENTION

Figure 1A:
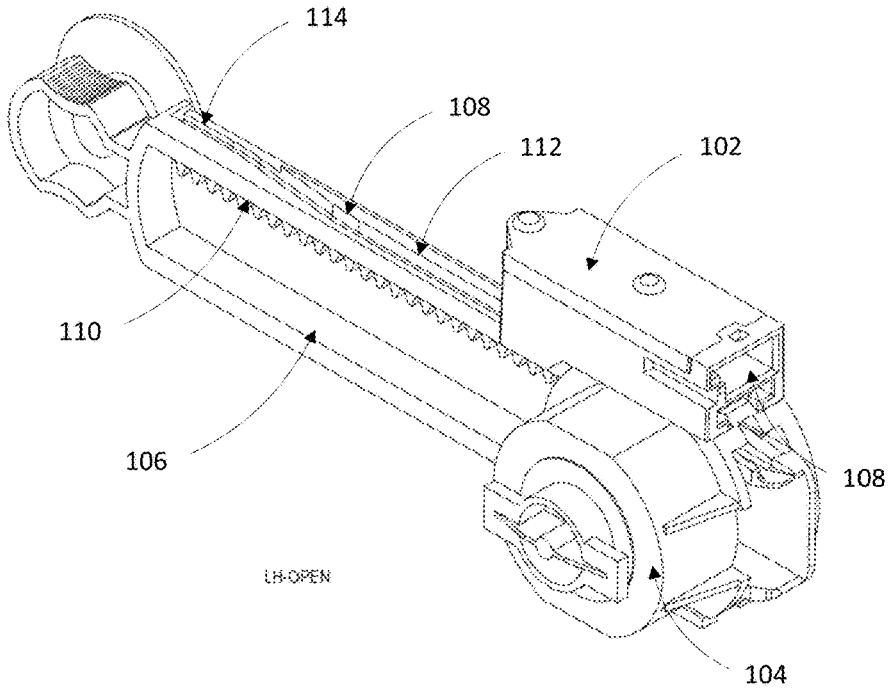
FIG. 1A depicts a push switch in the open position that is consistent with the present disclosure.
Figure 1B:
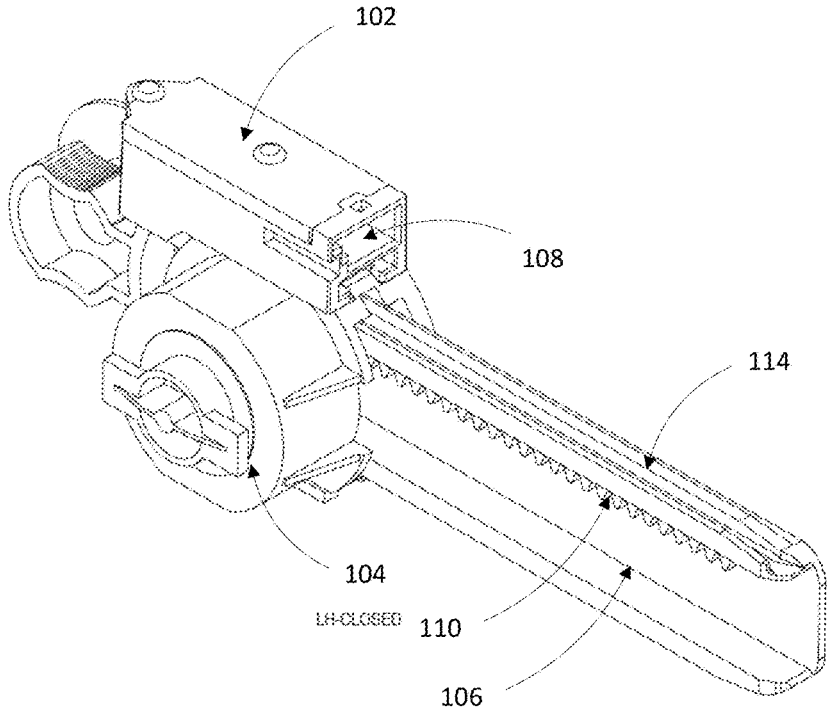
FIG. 1B depicts the push switch in the closed positon.

FIG. 1A depicts a push switch in the open position that is consistent with the present disclosure. The switch 100 includes a switch unit 102 that is affixed to a gear unit 104 with the gear unit 104 being slidably affixed to a rail 106. When the gear unit 104 moves along the rail 106, the switch unit 102 moves with gear unit 104. The rail 106 includes a slot 108 formed on a top surface of the rail 106 and gears 110 formed on an inner surface of the rail 106 opposite the slot 108. The gear unit 110 includes teeth that engage the gears 110 on the rail 106. The slot 108 includes a straight section 112 and a curved section 114. The switch unit 102 includes an extension that engages the slot 108 to manipulate contacts in the in gear unit. The switch unit 102 includes an opening 116 that is sized to engage a plug unit (not shown) with the plug unit providing power to contacts in the switch unit 102. FIG. 1B depicts the push switch in the closed positon. In the closed position, no power is provided to the contacts in the gear u nit 102.

Figure 2:
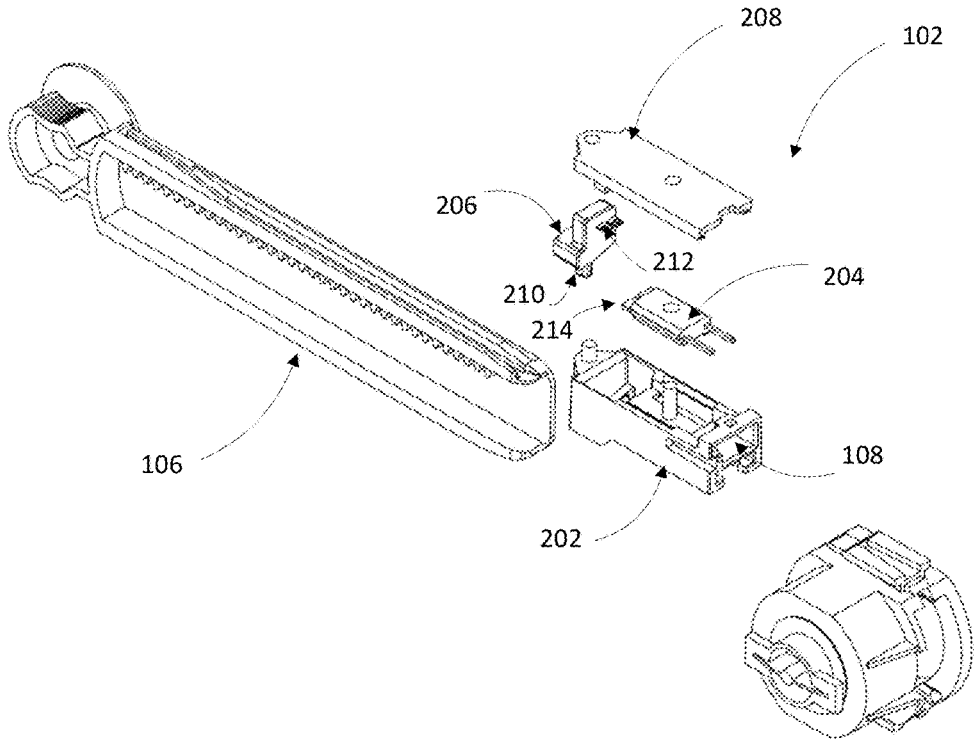
FIG. 2 depicts a break away view of the switch unit.

FIG. 2 depicts a break away view of the switch unit 102. The switch unit 102 includes a housing 202, a stationary contact unit 204, a toggle contact unit 206 and a cover 208. During operation, an extension unit 210 on the toggle contact unit 206 engages the slot 108 on the rail 106. The toggle contact 206 is configured to move laterally in relation to the housing 202 such that contacts 212 on the toggle contact 206 engage and disengage the stationary contact unit 204. The stationary contact unit 204 is positioned on a top portion of the switch unit 102 and is aligned with the toggle contact unit 206 such that the contacts 212 on the toggle contact unit align with and engage the contacts 214 on the stationary contact unit 204 when the switch is in the open position.

Figure 3:
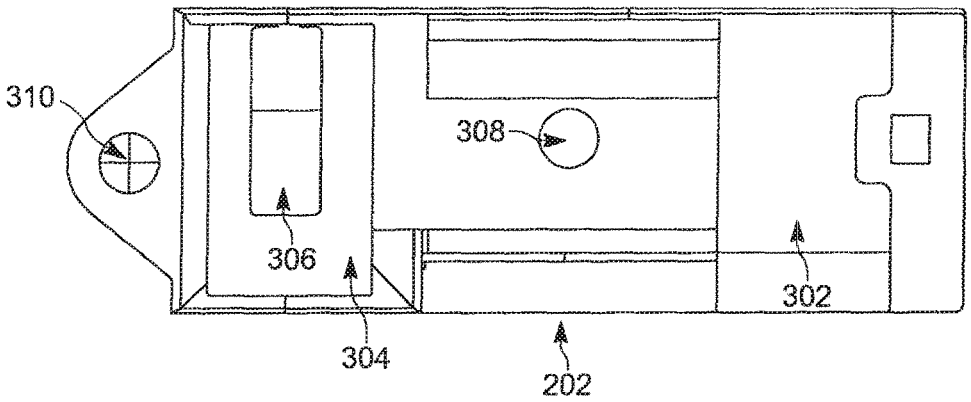
FIG. 3 depicts a top view of the housing unit.

FIG. 3 depicts a top view of the housing unit 202. The housing unit 202 includes a front portion 302 and a back portion 304. The front portion 302 includes a pin 308 that engages an opening in the stationary contact unit 204 such that the stationary contact unit 204 is positioned on a top area of the first portion 302 to form a cavity between the bottom of the housing 202 and the bottom of the stationary contact unit 204. The pin 308 is sized such that the pin engages an opening on the stationary contact unit 204 and an opening in the cover 208. The back portion 304 includes a slot 306 that is sized to engage the extension unit 210 on the toggle contact unit 206 such that the toggle contact unit 206 moves laterally in the housing 202. A tab 310 with a second pin 312 extends off the back portion. The second pin 312 is configured to engage an opening in the cover 208. The slot 306 is sized such that the toggle contact unit 206 moves between a position aligned with the contacts 214 on the stationary contact unit 206 an a position where the contacts 212 and 214 are not aligned.

Figure 4A:
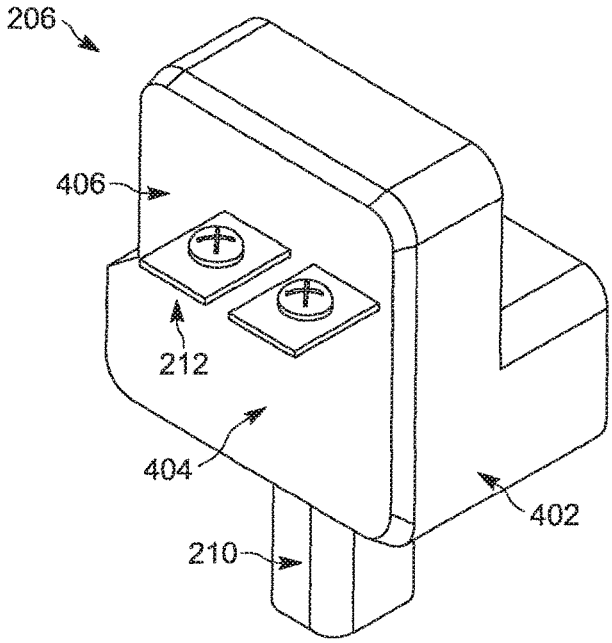
FIG. 4A depicts a perspective view of the toggle contact unit.

FIG. 4A depicts a perspective view of the toggle contact unit 206. The toggle contact unit 206 includes the extension unit 210 on the bottom portion of a base unit 402 with two contacts 212 positioned on a back surface 404 of the base unit 402. The contacts 212 are positioned closer to one side of the back surface 404 such that a gap 406 having a length of x is created between the contacts and one side of the back surface 404. The gap 406 is sized such that the contacts 212 engage the contacts 214 on the stationary contact unit 204 when the housing 202 is at one position on the rail 106 and do not engage the contacts 214 when the housing 202 is in a second position on the rail 106. In one embodiment, the extension unit 210 is configured to engage the slot 108 such that the contacts 212 on the toggle contact unit 206 are aligned with the contacts 214 on the stationary contact unit 204 when the housing 202 in in the straight section 112 of the slot 108 and the contacts 212 on the toggle contact unit 206 are not aligned with contacts 214 on the stationary contact unit 204.

Figure 4B:
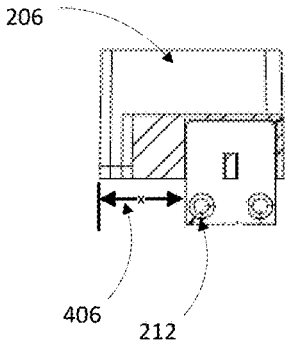
FIG. 4B depicts a cut away view of the toggle contact unit.

As the housing 202 moves from the straight section 112 of the slot 108 to the curved section 114 of the slot 108, the extension unit 212 moves the toggle contact unit 206 in the slot 306 in the housing unit 202 away from the contacts 214 on the stationary contact unit 204. When the housing 202 moves from the curved section 114 to the straight section 112, the toggle contact unit 206 moves back into contact with the contacts 214 on the stationary contact unit 204. By moving the toggle contact unit 206 in relation to the contacts 214, a circuit created by contacts 214 and contacts 212 is switched on and off. When the contacts are engaged, a circuit is closed between the power provided to by the plug (not shown) and an electrical device connected to the contacts 212 and 214. FIG. 4B is a cut away view showing the contacts 212 offset from an edge of the gap 406 having a length x.

Figure 4C:
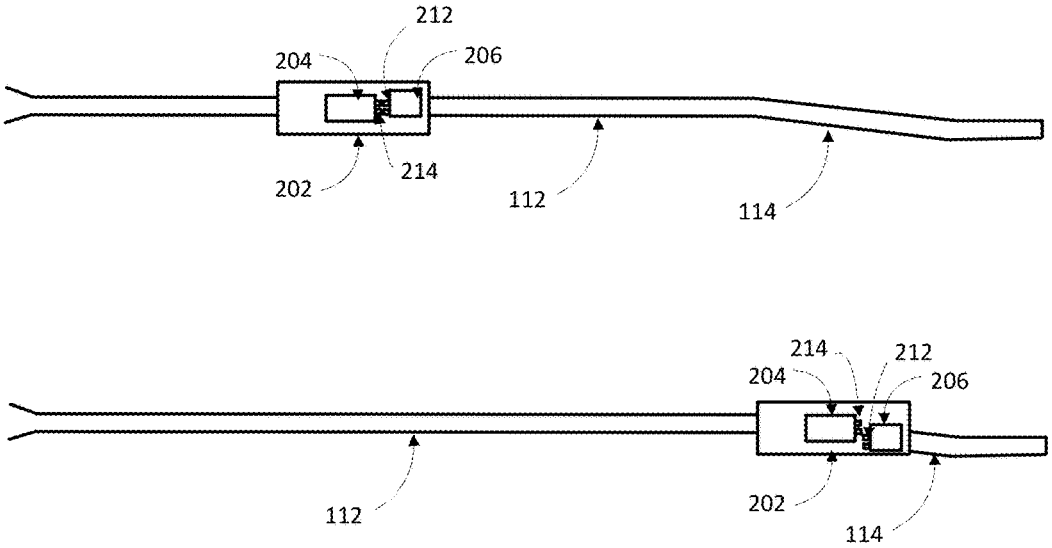
FIG. 4C depicts the position of the toggle contact unit as it moves along the slot.

FIG. 4C depicts the position of the toggle contact unit 206 as it moves along the slot 108. The extension unit 210 on the toggle contact unit 206 extends through the slot 306 to slidably engage the slot 108 in the rail 106 such that the extension unit 210 moves along the slot 108 as the housing 102 is moved with the gear unit 104. In the straight section 112, the toggle contact unit 206 is aligned with the stationary contact unit 204 such that the contacts 212 and contacts 214 are engaged. As the housing 102 moves along the curved section 114, the toggle contact switch 206 moves away from the contacts 214 in the housing 102 by the movement of the extension unit 210 in the slot 108 to disengage the contacts 212 from the contacts 214.

Figure 5:
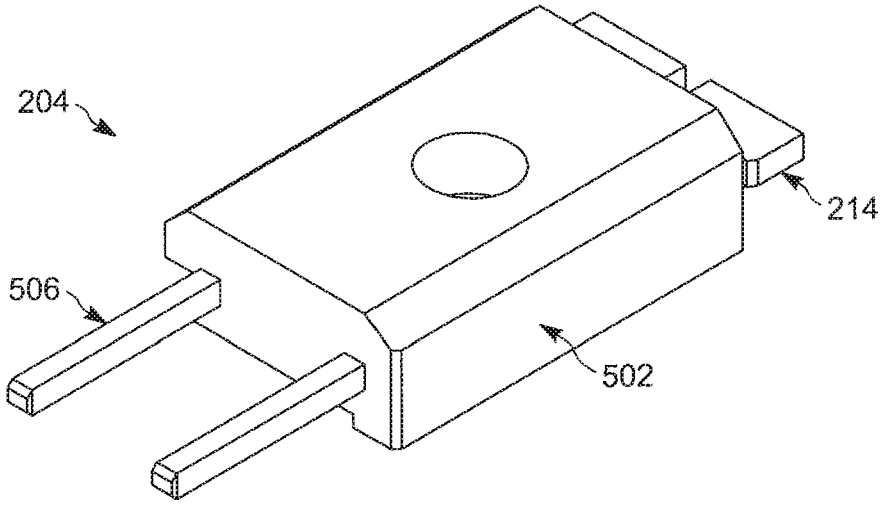
FIG. 5 depicts the stationary contact unit.
Figure 6:
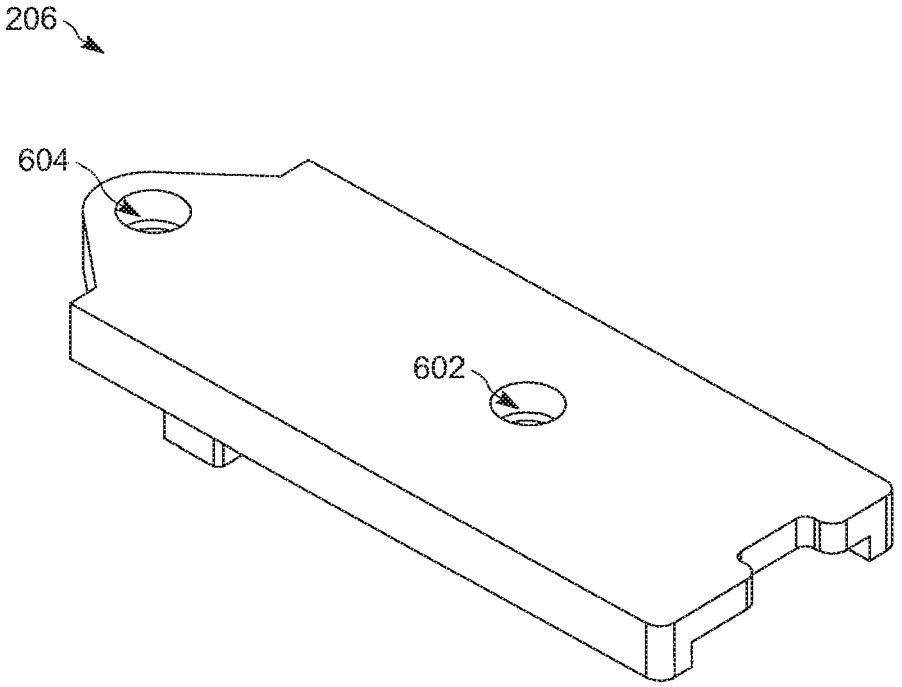
FIG. 6 depicts the cover of the housing.

FIG. 5 depicts the stationary contact unit 204. The stationary contact unit 204 includes contacts 214 on one end of a base 502 and second contacts 504 where the second contacts 504 are configured to engage openings in a plug (not shown) that engages the opening 108 of the housing 102. The base 502 includes an opening 506 that is sized to engage the second pin 308 of the housing 102. FIG. 6 depicts the cover 208 of the housing 102. The cover 208 includes opening 602 that is sized to engage the second pin 308 of the housing 102 and opening 604 that is sized to engage the pin 306 in the housing. When assembled, the cover 208 may be permanently affixed to the housing 102. In another embodiment, the cover 208 is removably affixed to the housing.

Figure 7:
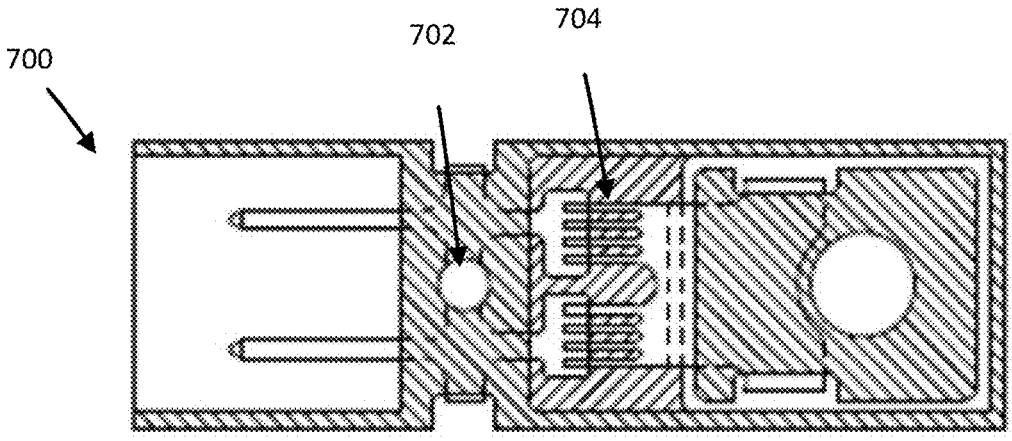
FIG. 7 depicts one embodiment of a push switch.

FIG. 7 depicts one embodiment of a push switch. The stationary contact unit 700 includes a pin 703 positioned between the pins 308 to separate the pins 308. The contacts 206 on the toggle contact switch 200 are bifurcated. In one embodiment, the contacts 206 have four distinct branches.

Figure 8:
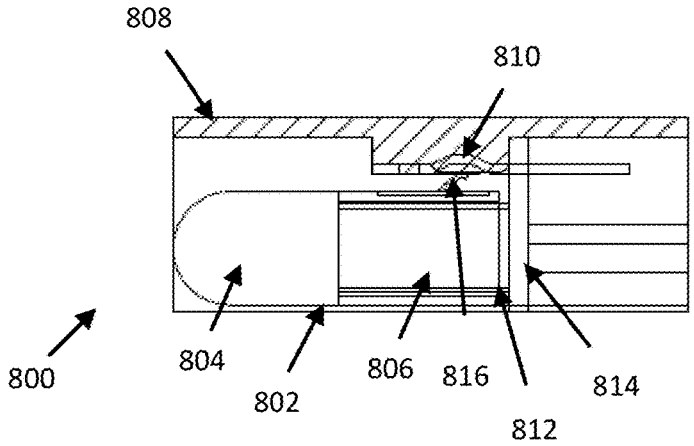
FIG. 8 depicts a push switch consistent with the present disclosure.

FIG. 8 depicts a push switch consistent with the present disclosure. The push switch 800 includes a button 802 having an engagement portion 804 and a switch portion 806. The button 802 is placed into a channel 808 with a contact unit 810 affixed to the surface of the channel facing the button 802. In one embodiment, the contact unit 810 is over-molded onto the surface of the channel. The engagement portion 804 is configured to engage a surface, such as the surface of a door, and to move into the channel 808 when the engagement portion 804 contacts the surface, and to move out of the channel 808 when the engagement portion 804 is not in contact with the surface. A biasing member 812 such as a spring, may be positioned between the switch portion 806 the button 802 and a back wall 814 of the channel 808.

An extension unit 816 extends from a side of the switch portion 806 of the button 802 on a side of the button 802 facing the contact unit 810. The extension unit 816 and contact unit 810 are made from a conductive material including, but not limited to, copper. The extension unit 816 is positioned such that the extension unit 816 engages a channel in the central portion of the contact unit 810. The extension unit 816 is positioned on the switch portion 806 of the button 802 such that the extension unit 816 engages the contact portion 810 when the engagement portion 804 of the button 802 is not engaging a surface and is extended out of the channel 808, and the extension unit 816 disengages the contact unit 810 when the engagement portion 804 is in contact with a surface and the button 802 is pushed into the channel 808.

Figure 9:
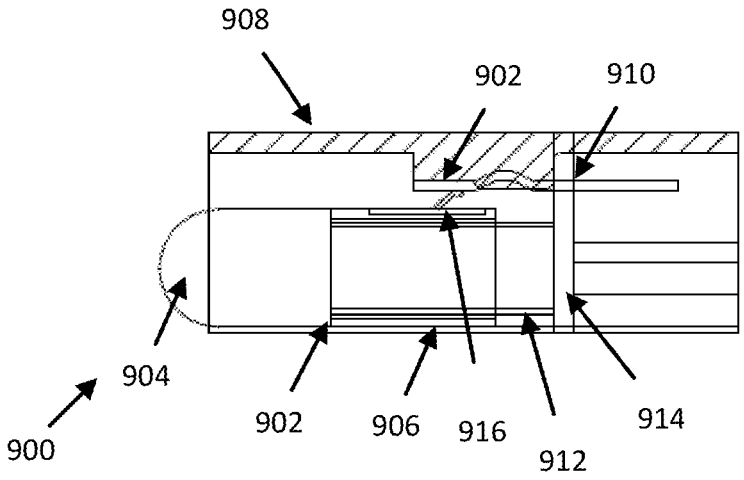
FIG. 9 depicts the push switch of FIG. 8 with the button moved out of the channel.

FIG. 9 depicts the push switch of FIG. 1 with the button 802 moved out of the channel 808. The extension unit 816 engages a contact pad 902 on the contact unit 810 when the engagement portion 804 is outside the channel 808. When the extension unit 816 engages the contact unit 810, electrical current flows through the contact unit 810 via the extension unit 816. In one embodiment, the position of the extension unit 816 on the switch portion 806 of the button 802 is arranged such that the extension unit 816 engages the contact pad 902 when the engagement portion 804 of the button is pressed into the channel 808, and the extension unit 816 does not engage the contact pad when the engagement portion 804 of the button 802 is outside the channel.

Figure 10:
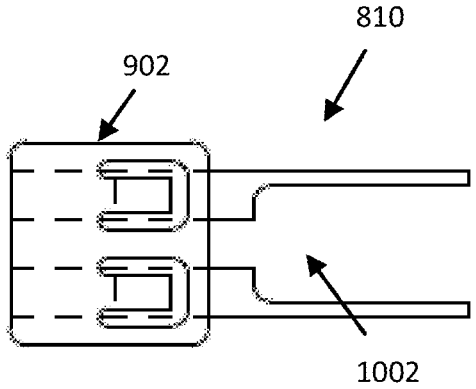
FIG. 10 depicts a top view of the contact unit.

FIG. 10 depicts a top view of the contact unit 810. The contact unit 810 includes the contact pad 902 and the contact channel 808 formed by the prong units 1002. The engagement unit 816 is sized such that the engagement unit 816 moves between the prong units 1002 in the channel when the button 802 is pressed and onto the contact pad 902 when the button is depressed.

Figure 11:
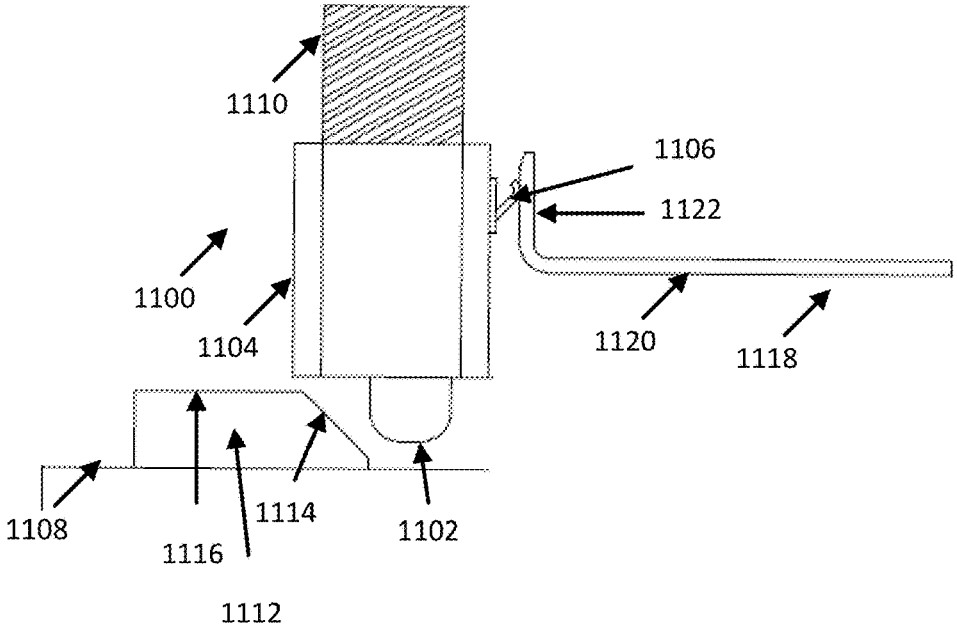
FIG. 11 depicts another embodiment of a push switch.

FIG. 11 depicts another embodiment of a push switch. The push switch 1100 includes an engagement portion 1102, a base portion 1104 and an extension unit 1106 on a side of the base portion 1104. The engagement portion 1102 of the push switch 1100 is biased onto a surface 1108 by a biasing unit 1110, such as a spring. A ramp unit 1112 is formed on surface 1108 with the ramp unit 1112 including a inclined portion 1114 that slopes towards the push switch 1100 such that the push switch 1100 slides along the inclined portion 1114 to a top portion 1116 that is substantially flat. When the engagement portion 1102 is in contact with the surface 1108, the extension unit 1106 is in contact with a contact unit 1118. The contact unit 1118 includes a portion that extends parallel 1122 to the side of the push switch 1100 and a portion that is perpendicular 1120 to the side of the push switch 1100. As the engagement portion 1102 moves along the surface 1108, the engagement unit 1102 and base portion 1104 move away from the surface 1108 moving the extension portion 1106 along the parallel portion 1122 of the contact unit 1118. The parallel portion 1122 of the contact unit 1118 is positioned such that the extension unit 1106 disengages the contact unit 1118 when the engagement unit 1102 is on the top portion 1116 of the ramp 1112.

Figure 12:
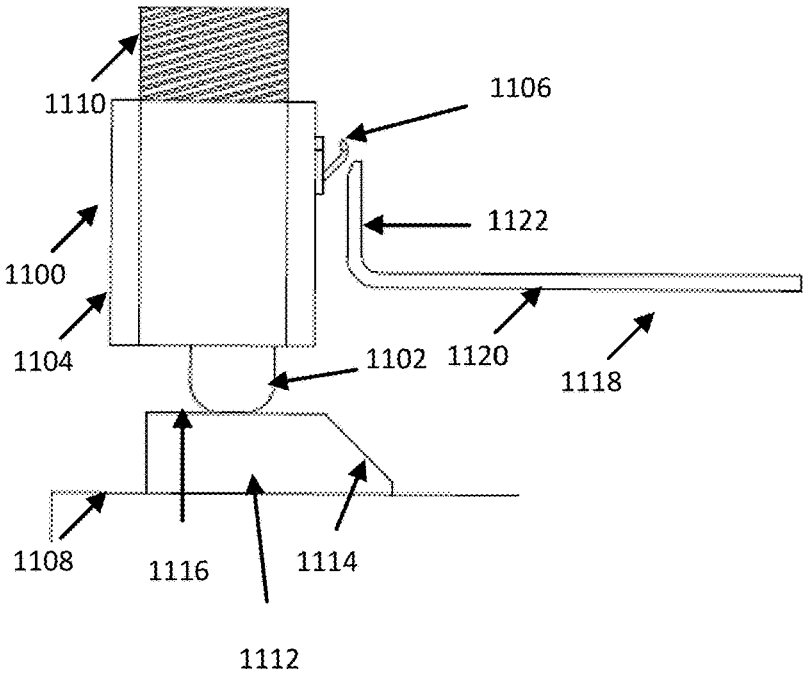
FIG. 12 depicts the push switch of FIG. 11 on the top portion of the ramp unit.

FIG. 12 depicts the push switch of FIG. 11 on the top portion of the ramp unit 1112. As the push switch 1100 moves up the ramp unit 1112, the biasing unit 1110 is compressed. The extension unit 1106 moves away from the parallel portion 1122 of the contact unit 1118 such that the extension unit 1106 does not engage the contact unit 1112.

Figure 13:
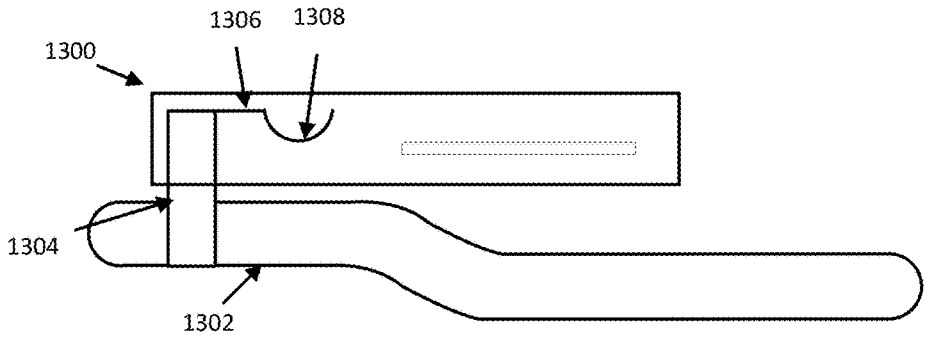
FIG. 13 depicts another embodiment of a push switch.
Figure 14:
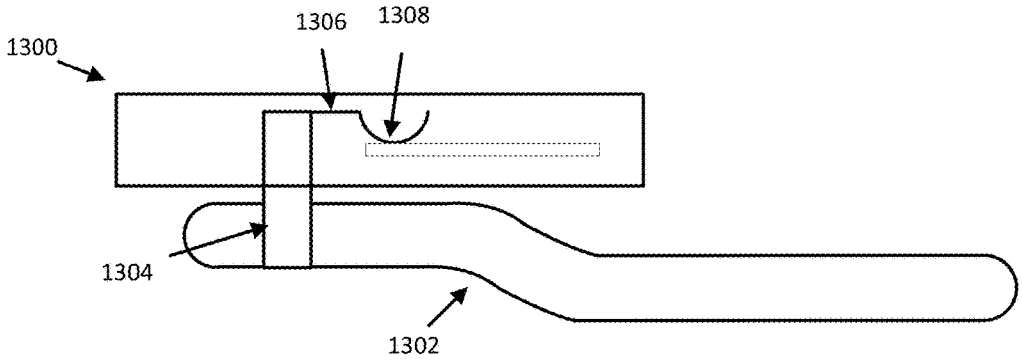
FIG. 14 depicts the engagement unit engaging the contact pad when the arm is retracted inward.

FIG. 13 depicts another embodiment of a push switch. The push switch 1300 is attached to an arm 1302 of a drawer such as, but not limited to, a glove compartment in a vehicle. The push switch 1300 includes an extension unit 1304 and an engagement unit 1306 on an end of the extension unit 1304. The extension unit 1304 is affixed to the arm 1302. The engagement unit 1306 includes a hooked portion 1308 that bows towards the arm 1302. The hooked portion 1308 of the engagement unit 1306 is positioned to engage a contact pad 1310 positioned above the arm 1302 as the arm 1302 moves into the closed position. The contact pad 1310 is positioned such that the engagement unit 1306 contacts the contact pad 1302 when the arm 1302 is in the retracted position and does not contact the contact pad 1302 when the arm 1302 is in the extended position. In one embodiment, the contact pad 1310 is positioned in an enclosure above the arm 1302. In another embodiment, the engagement unit 1306 contacts the contact pad 1310 when the drawer is the open position and the arm 1302 is fully extended outward.

FIG. 7 depicts the engagement unit 1306 engaging the contact pad 1310 when the arm 1302 is retracted inward. The hook portion 1308 is positioned such that a lower surface of the hook portion contacts a top surface of the contact pad 1310. When the hook portion 1308 contacts the contact pad 1310, an electrical circuit connected to the contact pad 1310 is completed and electricity can flow through the completed circuit.

In the present disclosure, the words "a" or "an" are to be taken to include both the singular and the plural. Conversely, any reference to plural items shall, where appropriate, include the singular.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A contact switch including:

a rail having a slot with a first straight section and a second curved section;

a toggle unit inside a housing, the toggle unit including an extension unit that slidably engages the slot and at least one contact;

a stationary unit in the housing including at least one contact;

wherein the toggle unit moves in the housing such that the at least one contact on the toggle unit engages the at least one contact on the stationary unit in the first straight section and the at least one contact on the toggle unit disengages the at least one contact on the stationary unit in the second curved section, and wherein the at least one contact on the toggle unit includes two contacts affixed to a back surface of the toggle unit with the two contacts being offset from one side of the back surface.

2. The contact switch of claim 1 wherein the at least one contact on the stationary unit includes four contacts.

3. The contact switch of claim 1, wherein the housing includes a pin that engages an opening on the stationary unit.

4. A glove compartment switch including:

a gear;

a rail connected to the gear, the rail having a slot with a first straight section and a second curved section;

a toggle unit inside a housing, the toggle unit including an extension unit that slidably engages the slot and at least one contact;

a stationary unit in the housing including at least one contact;

wherein the toggle unit moves in the housing such that the at least one contact on the toggle unit engages the at least one contact on the stationary unit in the first straight section and the at least one contact on the toggle unit disengages the at least one contact on the stationary unit in the second curved section, and the at least one contact on the stationary unit connected to a second set of contacts positioned on one side of the rail.

5. The glove compartment switch of claim 4 wherein the at least one contact on the toggle unit includes two contacts affixed to a back surface of the toggle unit with the two contacts being offset from one side of the back surface.

6. The glove compartment switch of claim 5 wherein the at least one contact on the stationary unit includes four contacts.

7. The glove compartment switch of claim 4 wherein the toggle unit includes an extension unit on a bottom surface with the extension unit being sized to engage a groove extending along the length of the rail.

8. The glove compartment switch of claim 7 wherein the extension unit passes through a slot in a bottom portion of the housing.

9. The glove compartment switch of claim 4 wherein the at least one contact on the stationary unit includes two contacts.

10. The glove compartment switch of claim 9 wherein the housing includes a pin that engages an opening on the stationary unit.

11. The glove compartment switch of claim 4 including a cover on the housing.

12. The glove compartment switch of claim 4 wherein the at least one contact on the stationary unit includes a first contact on a first side of the stationary unit and a second contact on a second side of the stationary unit opposite the first contact.

* * * * *